United States Patent [19]

Boulanger et al.

[11] Patent Number: 4,689,064

[45] Date of Patent: Aug. 25, 1987

[54] METHOD OF MAINTAINING CONSTANT THE COMPOSITION OF A PRODUCT STORED IN A LOW TEMPERATURE LIQUEFIED GAS STORE

[75] Inventors: Alain Boulanger, Levallois Perret, France; Walter Luyten, Schoten, Belgium

[73] Assignees: Societe Francaise de Stockage Geologigue Geostock-Tour Aurore, Paris La Defense, France; Societe Distrigaz, Brussels, Belgium

[21] Appl. No.: 921,075

[22] Filed: Oct. 21, 1986

[30] Foreign Application Priority Data

Oct. 21, 1985 [FR] France ..... 85 15562

[51] Int. Cl.[4] ..... F17C 13/00

[52] U.S. Cl. ..... 62/54; 220/85 VR

[58] Field of Search ..... 62/54; 220/85 VR, 85 VS; 55/89, 88

[56] References Cited

U.S. PATENT DOCUMENTS

| | | | |
|---|---|---|---|
| 2,959,928 | 11/1960 | Maker | 62/54 |
| 2,978,876 | 4/1961 | Pastuhov | 62/54 |
| 3,303,660 | 2/1967 | Berg | 62/54 |
| 3,857,251 | 12/1974 | Alleaume | 62/54 |
| 3,884,652 | 5/1975 | Nichols | 62/54 |
| 4,072,024 | 2/1978 | Higgins | 62/54 |

*Primary Examiner*—Ronald C. Capossela

*Attorney, Agent, or Firm*—Sughrue, Mion, Zinn, Macpeak and Seas

[57] ABSTRACT

A method for maintaining constant the composition of liquefied gas in a store (1) comprises extracting product in its gas phase from the store by means of a compressor (8) to raise its pressure. The gas is then cooled in a first heat exchanger (9) and then in a second heat exchanger (10), to a final temperature such that on expanding the gas into a tank (11) most of it is liquefied. The small amount of remaining gas is recycled to the compressor inlet after passing through the first heat exchange as its cooling fluid. The product is also extracted in its liquid phase (3) by a pump (19). The liquid is then passed through a battery of pumps (20) which raise it to a pressure high enough for a distribution network to be directly supplied therewith (after vaporization). A portion of the highly compressed liquid phase is used as the cooling fluid for the second heat exchanger (10).

3 Claims, 1 Drawing Figure

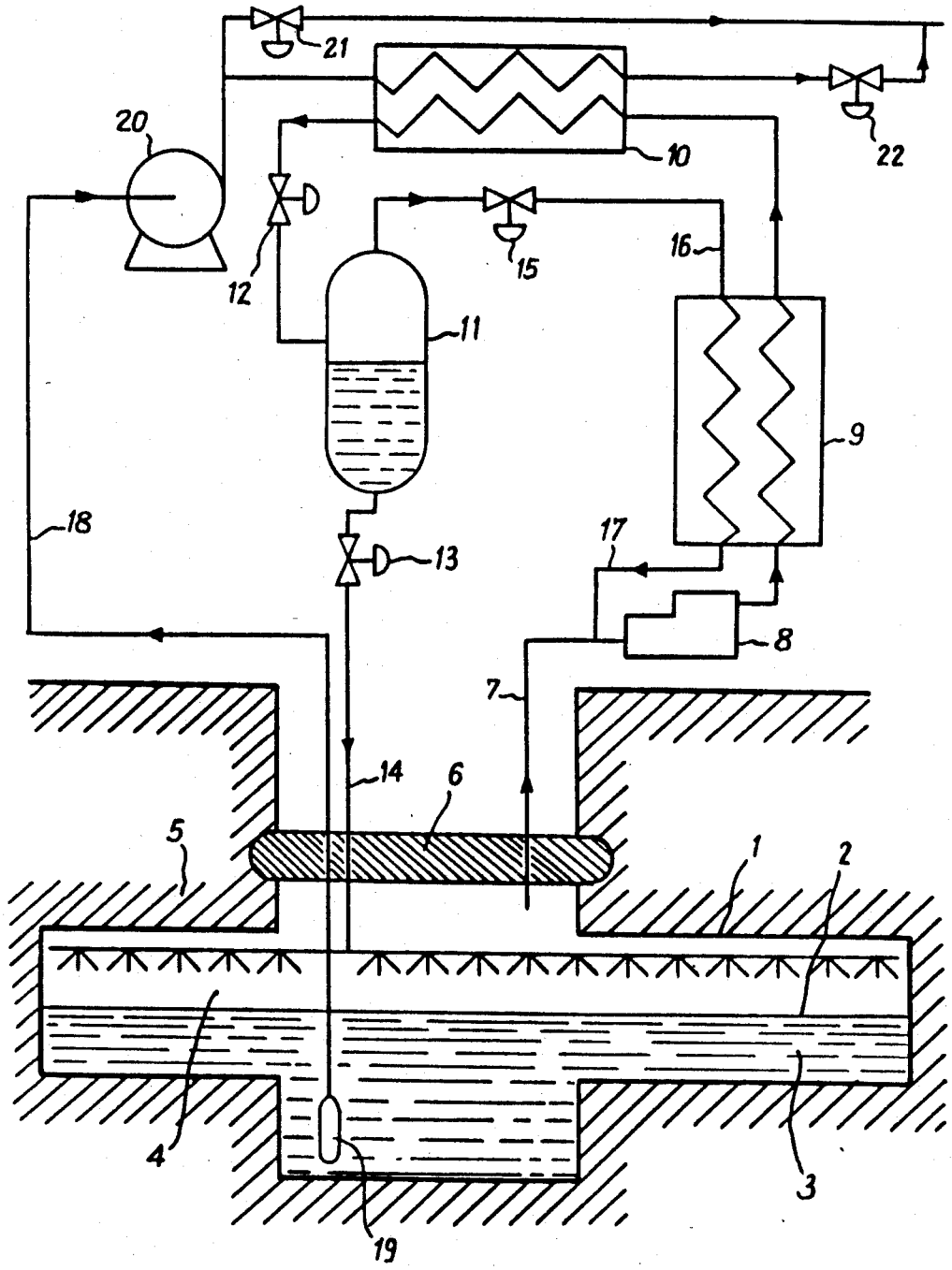
21
20
10
22
12
15
16
11
9
18
13
17
8
7
14
6
5
1
2
4
3
19

METHOD OF MAINTAINING CONSTANT THE COMPOSITION OF A PRODUCT STORED IN A LOW TEMPERATURE LIQUEFIED GAS STORE

The present invention relates to a method of maintaining constant the composition of a product stored in a low temperature store for liquefied natural gas.

BACKGROUND OF THE INVENTION

A store of liquefied natural gas, and in particular an underground store, suffers from an evaporation rate of about 0.5% per day, regardless of the nature of the rock formation in which the store is hollowed out. This value corresponds to storage conditions at temperatures lying in the range −162° C. to about −100° C.

Given that natural gas is not a pure gas but a mixture of different gases, and that the store contains two phases, the composition of the gas phase above the liquid phase will be different from the composition of the liquid phase itself.

However, in order to maintain the storage temperature and pressure conditions substantially constant, it is necessary to provide some means for allowing a certain rate of evaporation, and thus for substantially permanently allowing a portion of the stored gas phase to escape in order to compensate for the influx of heat, which in the case of an underground store comes from the the surrounding rock formation.

In an above-ground store associated with a unit for smoothing demand peaks, the waiting period is very long, and as a result the above-described phenomenon of the liquid phase becoming enriched in heavy fractions takes place in a manner similar to an underground store, even though the daily evaporation rate is lower.

Thus releasing a portion of the gas phase has the effect, in the long run, of modifying the composition of the stored product and in some cases this may lead to severe problems which need solving. For example, the composition of the stored product determines its heating power which in turn, for natural gas, determines the dimensions of the burners which can be fed with said gas, or the fuel consumption of said burners.

Preferred implementations of the present invention provide a method for maintaining a liquefied gas in storage at a constant composition.

SUMMARY OF THE INVENTION

The present invention provides a method of maintaining constant the composition of a liquefied gas in a store, the method comprising the steps of:

extracting the stored product in its gas phase;

compressing it by means of a compressor;

cooling the extracted product a first time in a first heat exchanger;

cooling it a second time in a second heat exchanger;

allowing it to expand into a tank, with its temperature on leaving the second heat exchanger being such that after expanding into said tank a portion of the product is in its liquid phase;

returning said liquid phase to the store;

returning the gas phase of the product in said tank to the inlet to said compressor via said first heat exchanger to cool the product leaving said compressor;

extracting the liquid phase of said stored product from said store by means of a pump;

compressing said liquid phase extracted from said store by means of a battery of pumps;

passing a portion of the product leaving said battery of pumps through the second heat exchanger to cool the product leaving said first heat exchanger; and causing said portion to rejoin the remainder of the product leaving said battery of pumps and applying the rejoined output from said battery of pumps to a distribution network, after vaporization.

The flowrates of the various products at various conditions of temperature, pressure and phase are controlled by first, second, and third control valves provided respectively between the first heat exchanger and said tank, between said tank and the underground cavity, and between said tank and the first heat exchanger, and by fourth and fifth control valves respectively provided between said battery of pumps and the distribution network and between the second heat exchanger and the distribution network.

BRIEF DESCRIPTION OF THE DRAWING

An implementation of the invention is described by way of example with reference to the sole FIGURE of the accompanying drawing which is a theoretical diagram of an installation suitable for implementing the method of the invention in conjunction with an underground store.

MORE DETAILED DESCRIPTION

In the accompanying FIGURE, an underground storage cavity 1 contains a stored product, for example liquefied natural gas under a pressure which lies in the range atmospheric pressure to a few atmospheres.

In the top portion of the cavity, above the surface 2 of the liquid phase 3, the product occurs in the gas phase 4 due to evaporation from the liquid phase. The compositions of the liquid and gas phases are different because the stored product is not pure but comprises a mixture of pure compounds each having different evaporation properties. Evaporation is caused by external heat influx from the surrounding rock formation 5 and its environment. It is the evaporation which ensures that the storage temperature remains substantially constant, which temperature is a function of the operating pressure and may lie in the range about −125° C. to about −160° C. The top of the cavity is closed by a sealed stopper 6 through which various ducts pass.

In accordance with the present invention, the gas phase of the stored product is extracted by means of a duct 7 via a compressor 8 which compresses it to an adjustable pressure of about 10 atmospheres (or bars) depending on the operating conditions of the installation. The product is then caused to pass through a first heat exchanger 9 where it is cooled a first time, and then through a second heat exchanger 10 where it is cooled a second time, and it leaves the second heat exchanger at a temperature such that after expansion into a tank 11, for example via a Joule-Thomson type first valve 12, it arrives in the said tank 11 mainly in the liquid phase which is then returned to the underground storage cavity via a second control valve 13 and a duct 14. The product which arrives in said tank 11 in the gas phase is caused to pass via a third control valve 15 and a duct 16 through said first heat exchanger 9 in order to cool the compressed gas leaving said compressor 8, prior to being directed itself to the inlet of said compressor 8 via a duct 17 connected to the duct 7 in order to be recycled round the circuit through which it has already passed, until it arrives as liquid phase in said tank 11.

In addition, product is taken from the liquid phase 3 stored in the underground cavity 1 via a duct 18 and by means of a pump 19. The product is then raised in pressure by a battery of pumps 20 until it reaches a pressure such that the network for distributing the product to the outside can be fed directly from said battery of pumps after vaporization, i.e. up to about 80 bars in the present example. A portion of the product leaving said battery pumps 20 is passed into the second heat exchanger 10 to cool the compressed gas leaving the first heat exchanger 9. In the present example, said portion of the product leaving said battery of pumps 20 enters the second heat exchanger 10 at a temperature close to −150° C. and leaves at a temperature of about −80° C. The flowrate of the product leaving said battery of pumps 20, and the proportion of said product which enters the second heat exchanger 20 are adjustable by means of fourth and fifth control valves 21 and 22 which are used together, with the fourth control valve 21 being mounted in parallel with the second heat exchanger 10 and the fifth control valve 22, which are themselves connected in series with the outlet from said battery of pumps 20. The outlets from the fourth and fifth control valves 21 and 22 are connected together to a common outlet which is intended for connection to the network for distributing the product to the exterior, after vaporization.

Operating parameters such as temperature, pressure, and flowrate at the various stages of the method depend firstly on the composition of the product, and secondly on the operating conditions applicable to the installation to which the method in accordance with the present invention is applied.

There are three main types of installation associated with an underground store of liquefied natural gas:

peak demand smoothing units;

export terminals; and reception terminals.

A peak demand smoothing unit which is associated with an above-ground storage is operated at atmospheric pressure and at a temperature of about −160° C. The composition of the product may therefore be maintained by applying the method of the present invention.

In an export terminal, the store receives the stored product via a high capacity liquefying device and it is operated at atmospheric pressure and at about −160° C. The gas phase flowrate which is required is then marginal compared with the rate at which the store is filled and its influence on the composition of the product is negligible.

In a reception terminal, the underground storage is operated at a pressure which may vary between atmospheric pressure and a few atmospheres, but in general, the associated equipment does not include a liquefying device. However, the installation must be designed to output gas into the distribution network with a composition which is as constant as possible. An installation of the type described with reference to FIG. 1 is applicable thereto.

We claim:

1. A method of maintaining constant the composition of a liquefied gas in a store, the method comprising:

extracting stored product in its gas phase;

compressing it by means of a compressor;

cooling the extracted product a first time in a first heat exchanger;

cooling it a second time in a second heat exchanger;

allowing it to expand into a tank, with its temperature on leaving the second heat exchanger being such that after expanding into said tank a portion of the product is in its liquid phase;

returning said liquid phase to the store;

returning the gas phase of the product in said tank to the inlet to said compressor via said first heat exchanger to cool the product leaving said compressor;

extracting the liquid phase of said stored product from said store by means of a pump;

compressing said liquid phase extracted from said store by means of a battery of pumps;

passing a portion of the product leaving said battery of pumps through the second heat exchanger to cool the product leaving said first heat exchanger; and causing said portion to rejoin the remainder of the product leaving said battery of pumps and applying the rejoined output from said battery of pumps to a distribution network, after vaporization.

2. A method according to claim 1, wherein a Joule-Thomson type control valve is provided upstream from said tank.

3. A method according to claim 1, wherein said expansion of the product into said tank is adiabatic.

* * * * *